US005131313A

United States Patent [19]

Zimmerman

[11] Patent Number: 5,131,313

[45] Date of Patent: Jul. 21, 1992

[54] LINEAR ACCELERATOR

[76] Inventor: Theodore Zimmerman, 66 St. Charles Ave., West Caldwell, N.J. 07006

[21] Appl. No.: 635,645

[22] Filed: Nov. 28, 1990

[51] Int. Cl.[5] ..... F41A 1/02; F41A 1/04

[52] U.S. Cl. ..... 89/7; 89/8

[58] Field of Search ..... 89/7, 8

[56] References Cited

U.S. PATENT DOCUMENTS 4,050,348 9/1977 Graham ..... 89/7

4,376,406 3/1983 Black ..... 89/7

FOREIGN PATENT DOCUMENTS 1056968 5/1959 Fed. Rep. of Germany ..... 89/8

862334 3/1941 France ..... 89/8

*Primary Examiner*—Stephen C. Bentley

*Attorney, Agent, or Firm*—Costa Perchem

[57] ABSTRACT

A linear accelerator mounted on a launcher that injects propellant into a launcher behind a projectile causing the projectile to achieve greater distances. The launcher has apertures along its longitudinal surface allowing propellant to enter the inner cavity of the launcher. When the projectile is fired, additional propellant is introduced behind the projectile giving it additional impetus.

6 Claims, 2 Drawing Sheets

LINEAR ACCELERATOR

BACKGROUND OF INVENTION

This invention relates to a mounting device and more particularly relates to a mounting device placed on a launcher, either in series or parallel along the length of said launcher. The use of the mounting device provides injection of propellant into the combustion chamber of the launcher regulating the explosive gases behind the exiting projectile. In addition, maintaining the explosive gases constant along the gradient of the launcher which extends the distance, velocity and the impact of the projectile. This is accomplished by making use of multiple impulses along the total extent of the launcher. The mounting device consists of auxiliary stations placed along the launcher so as the projectile passes a predetermined point, propellant is injected behind the projectile. The propellant ignites which yields an increase range and higher velocity to the projectile while maintaining the internal combustion chamber pressure. Using the method described herein the launcher can launch projectiles at ultra high velocities at relatively low combustion chamber pressures. Velocities are attainable for sub-orbital and orbital escape velocities using this invention. In a typical launching the interior ballistic pressure vs. time curve reaches a peak pressure and once that is achieved then decays rapidly as the projectile moves along the combustion chamber. As a result of the rapid changes in the propellant gas pressure the projectile experiences a high "g" load or acceleration capable of severe damage to components within the projectile. Subject invention maintains a uniform interior pressure level over the entire combustion chamber and yields a flat pressure vs. time curve with a smooth uniform projectile acceleration. Since the work performed on projectile is related to the area under the pressure vs. time curve, the work imparted to the projectile having a constant pressure maintained behind the projectile will lower "g" forces applied to the projectile and yields the advantage of a "spot" projectile launch.

PRIOR ART

In U.S. Pat. No. 4,376,406 dated Mar. 15, 1983 entitled Hybrid Gun System there was disclosed a doughnut piston which must seal the entire outer gun barrel surface requiring it to be accurately machined and assembled. In addition, the maximum pressure attained cannot exceed the chamber bore pressure on the doughnut piston requiring a relatively large volume of gas to actuate the piston. The hybrid system exhibits small variations in pressure oscillations compared to a total liquid projectile system as shown in U.S. Pat. No. 4,050,348 where injection is made in a fine mist directly into the flame front.

SUMMARY OF THE INVENTION

This invention consists in certain novel features of construction a combination in parts, hereinafter set forth and claimed, which are embodied to extend distances projectiles and missiles travel or to increase the impact of a projectile or a missile on a target. It is therefore an object of this invention to provide a mounting support for a lever system placed upon a launcher. Another object is to provide a lever system which injects propellant into the combustion chamber for the generation of additional propellant gases. A further object is to provide means to reliably and releaseably supply energy as the projectile moves along the launcher. A still further object is to provide an injection of a pre-determined amount of propellant into the combustion chamber. A still further object is to provide means to regulate the distance a projectile travels by controlling the volume of propellant injected into the combustion chamber. A still further object is to provide means for a lever system to provide a mechanical advantage either to increase or decrease the incoming volume of propellant.

These and other objects of the invention will become apparent in view of the following specification, claims and drawings in which like parts are shown with like numbers.

DESCRIPTION OF THE PREFERRED EMBODIMENT

Figure 1:
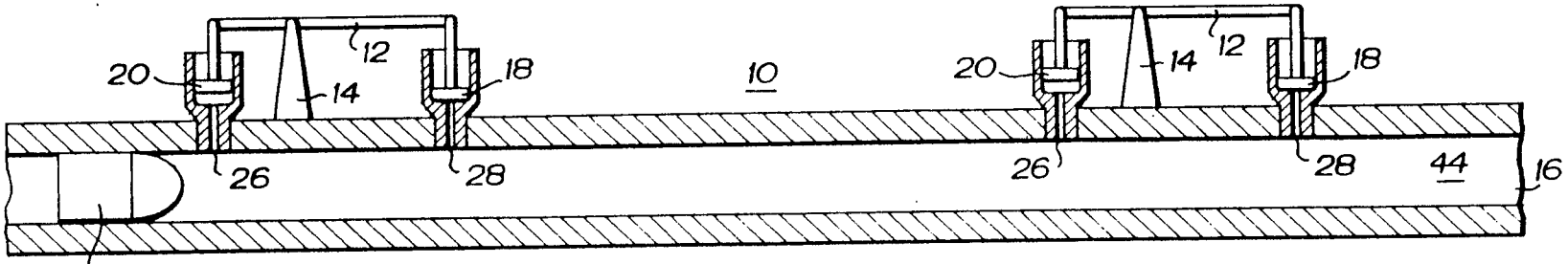
FIG. 1 is a cross-sectional side view of a projectile within the launcher at the first stage of its progression through the launcher.
Figure 2:
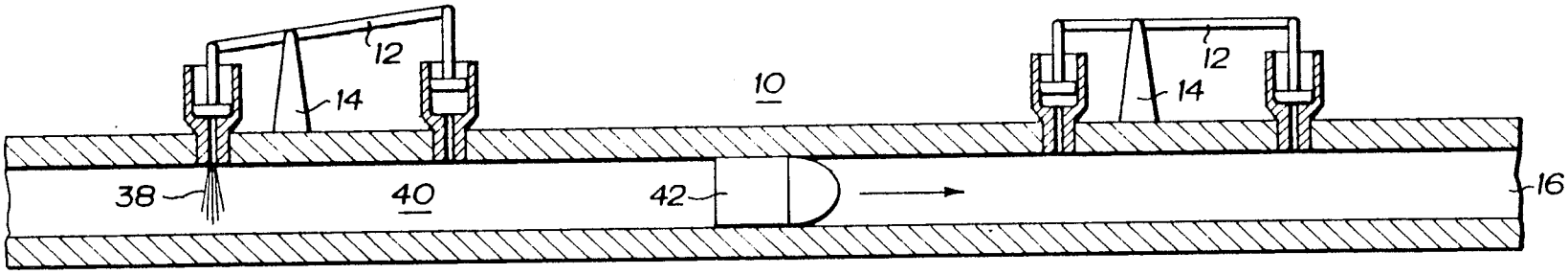
FIG. 2 is a cross-sectional side view of a projectile past the first stage.
Figure 3:
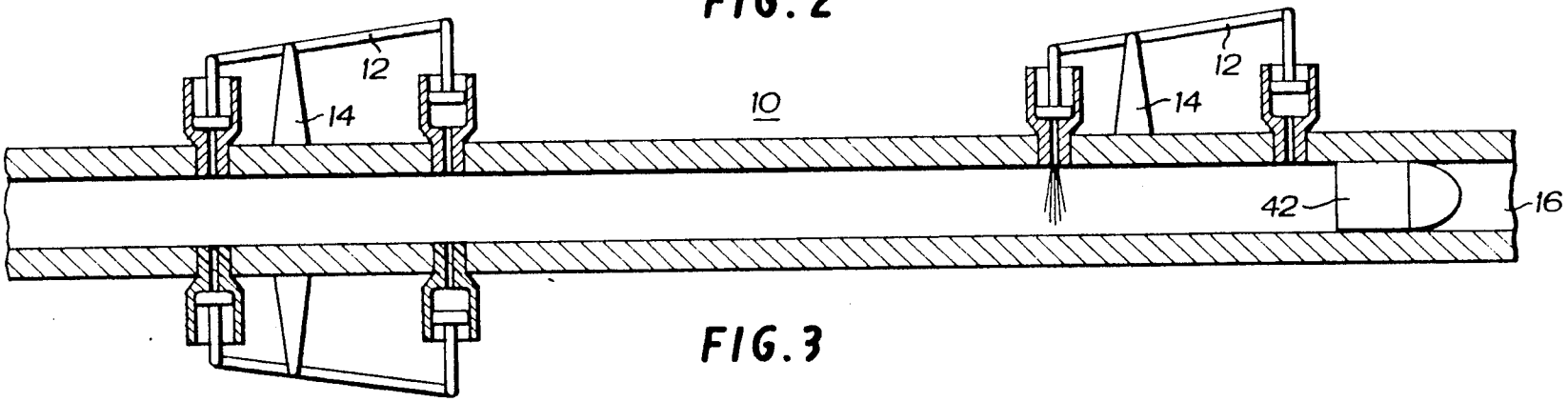
FIG. 3 is a cross-sectional side view of a projectile past the second stage. It also shows the linear accelerator in series and in parallel.
Figure 4:
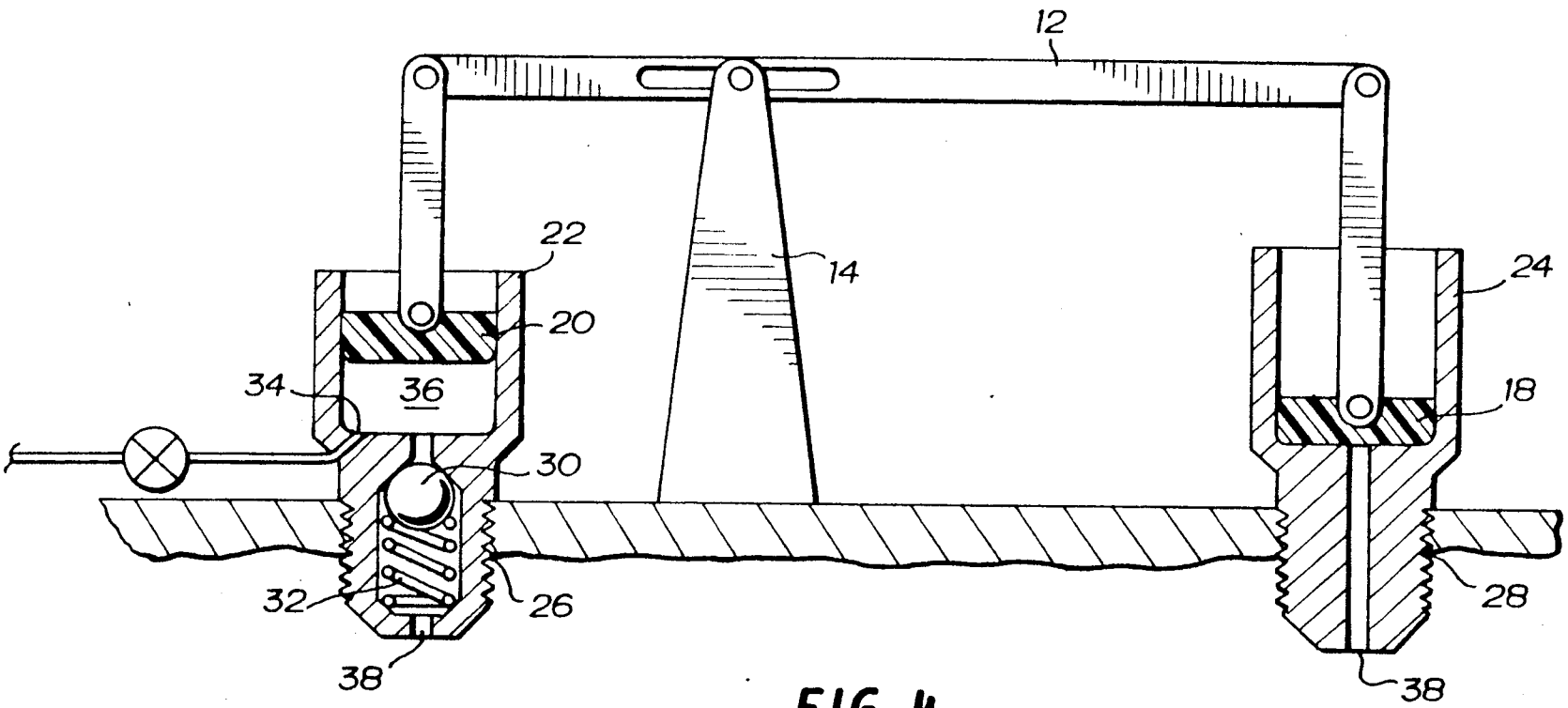
FIG. 4 is the cross section of the cantilever beam affixed to a fulcrum and the pistons at each end of the beam in a normal "battery " position prior to firing.

Referring to the drawings wherein like parts throughout the various figures are designated by like reference numerals and referring to FIG. 1, the linear accelerator 10 comprises a cantilever beam 12 mounted on a slidable fulcrum 14 which is affixed to a launcher 16. At each end of said beam 12 is connected to propellant pistons 20 and reaction piston 18 located within cylinders 22 and 24 (shown on FIG. 4) which is threadably attached through apertures 26 and 28 in said launcher 16. Referring to FIG. 4 a metal ball 30 seals the contents being retained in cylinder 22 which is supported by a spring 32.

An aperture 34 is provided on the side of cylinder 22 in order to supply propellant into cylinder cavity 36 after the propellant is expended into the combustion cavity 40 of launcher 10. After reach firing, liquid propellant is pumped into the auxiliary stages. As the liquid propellant enters cylinder 22, the propellant piston 20 and reaction piston 18 are moved into the "battery" position in preparation for the next firing. A pump is used to provide liquid propellant into the cavity 36.

In operations, the projectile 42 is loaded into the launcher 16 in the normal manner and the breech is closed. The actuation of the primer is accomplished by either an electrical pulse or mechanically striking a percussion primer element which initiates the main solid propellant charge. As the solid propellant burns, gas pressure builds up in the breech chamber and the projectile 42 begins to move forward in the launcher 16. When the projectile 42 moves past cylinder 24 the reaction piston 18 located in cylinder 24 is exposed to the combustion chamber pressure and begins moving the propellant piston 20. The reaction piston 18 is attached to a lever 12 which forces propellant piston 20 down into cylinder 22 containing liquid propellant and or oxidizer into the combustion chamber 40 at a greater pressure than exist in the launcher tube 16. The higher pressure is achieved by the use of the fulcrum 14 which is movable providing the mechanical advantage along with the efficiency that of a small piston achieves on a non-compressable fluid. The result is that the liquid propellant and or oxidizer are forced into the combustion chamber at a much higher pressure than exists in the combustion chamber. The pressurized liquid propellant and or oxidizer is forced through an atomizing nozzle 38 which causes the liquid propellant and or oxidizer to break up into a fine mist. Ignition of the propellant and or oxidizer is immediate because the liquid propellant and or oxidizer injection takes place in the flame front of the solid propellant. There is no chuffing since the ignition of the liquid propellant and or oxidizer is super-quick and thus the pressure is maintained.

The pressure is prevented from falling along the combustion chamber 40 by having liquid propellant and or oxidizer injected at stations along the combustion chamber. Each station consist of a propellant piston 20 which activates a mechanical lever 12 that applies pressure to the cylinder 22 containing liquid propellant and or oxidizer. The mechanical advantage of the lever 12 creates a force that yields a pressure inside the propellant cylinder 22 on the liquid propellant and or oxidizer many times greater that he gas pressure inside the combustion chamber 40. Liquid propellant and or oxidizer is squirted through the nozzle injector into the stream of hot gases in the combustion chamber 40. The hot gases vaporize and ignites the injected propellant and oxidizer and the process is repeated as the projectile passes each station until it exits the combustion chamber. To prevent the burning hot gases from entering the liquid propellant pumping stations a ball valve seals the cylinder 22 whenever the pressure inside the cylinder 22 falls below the combustion chamber 40. When a sufficient number of auxiliary stages of the linear accelerator are placed upon a launcher, orbital and suborbital velocities can be achieved by the projectile.

It will be understood that the invention concept is not limited to the exact details of construction shown and described, since obvious modifications will occur to persons skilled in the art.

I claim:

1. A linear accelerator mounted on a launcher comprising in combination:

a cantilever with slidable fulcrum attached to said launcher;

a propellant piston and reaction piston pivotally mounted on opposite ends of said cantilever;

a first housing of round configuration threadably mounted on said launcher containing said propellant piston;

a second housing of round configuration threadably mounted on said launcher containing said reaction piston;

an aperture at base of said first housing and said second housing communicating with the interior cavity of said launcher;

a reservoir containing a propellant in said first housing; and means for holding and releasing said propellant in said first housing to allow passage through said aperture to permit normal and proper combustion in cavity of said launcher.

2. A linear accelerator as described in claim 1 wherein said propellant piston and said reaction piston is synchronized through said apertures on the base of said first housing and said second housing to maintain gas pressure constant on the inner longitudinal surface of said launcher until projectile exits said launcher causing the projectile to achieve greater distances.

3. A linear accelerator as described in claim 1 wherein said first housing and said second housing are synchronized through said aperture to maintain gas pressure constant on the inner longitudinal surface of said launcher until projectile exits said launcher.

4. A linear accelerator as described in claim 1 with at least one additional said accelerator after parallel in line 2 installed on said launcher either in series or in parallel along the length of said launcher.

5. A linear accelerator as described in claim 1 wherein said fulcrum is slidably adjustable to increased or decreased mechanical advantage of said pistons.

6. A linear accelerator as described in claim 1 wherein said first housing includes an aperture at base of said first housing to allow reloading with a propellant charge.

* * * * *